US009782885B2

(12) United States Patent
Yoshikane et al.

(10) Patent No.: US 9,782,885 B2
(45) Date of Patent: Oct. 10, 2017

(54) RECIPROCATING POWER TOOL

(71) Applicant: MAKITA CORPORATION, Anjo-shi, Aichi (JP)

(72) Inventors: Kiyonobu Yoshikane, Anjo (JP); Yoshitaka Machida, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 578 days.

(21) Appl. No.: 14/287,403

(22) Filed: May 27, 2014

(65) Prior Publication Data

US 2014/0352994 A1 Dec. 4, 2014

(30) Foreign Application Priority Data

May 29, 2013 (JP) ..... 2013-113512

(51) Int. Cl.
*B25D 17/00* (2006.01)
*B25F 5/00* (2006.01)
*B25D 17/04* (2006.01)

(52) U.S. Cl.
CPC ..... *B25F 5/006* (2013.01); *B25D 17/04* (2013.01); *B25D 17/043* (2013.01);
(Continued)

(58) Field of Classification Search
CPC . B25F 5/006; B25F 5/02; B25F 5/026; B25D 17/24; B25D 17/04
(Continued)

(56) References Cited

U.S. PATENT DOCUMENTS 4,401,167 A 8/1983 Sekizawa et al.
4,779,687 A * 10/1988 Schreiber ..... B23B 45/006 173/170
(Continued)

FOREIGN PATENT DOCUMENTS

EP 1674212 A1 6/2006
EP 1867442 A2 12/2007
(Continued)

OTHER PUBLICATIONS

Oct. 6, 2015, Extended Search Report issued in European Patent Application No. 14 17 0274.6.
(Continued)

*Primary Examiner* — Robert Long
(74) *Attorney, Agent, or Firm* — Oliff PLC

(57) ABSTRACT

Reciprocating power tool is provided which is improved in vibration isolation of the handle. The reciprocating power tool has a tool body and a handle connected to the tool body. When an axial direction of a tool bit is defined as a longitudinal direction, the handle extends in a vertical direction crossing the longitudinal direction. Further, an upper region of the handle is connected to the tool body via an elastic member and a lower region of the handle is connected to the tool body via a support shaft that it can rotate around an axis of the support shaft in a transverse direction crossing both the longitudinal direction and the vertical direction with respect to the tool body. When the handle rotates around the support shaft with respect to the tool body, the elastic member reduces vibration which is caused in the tool body and transmitted to the handle.

15 Claims, 2 Drawing Sheets

(52) U.S. Cl.
CPC .. *B25D 2211/003* (2013.01); *B25D 2211/061* (2013.01); *B25D 2250/345* (2013.01); *B25D 2250/371* (2013.01)

(58) Field of Classification Search
USPC ..... 173/162.1–162.2, 210–211, 170
See application file for complete search history.

(56) References Cited

U.S. PATENT DOCUMENTS 5,522,466 A * 6/1996 Harada ..... B25F 5/006 173/162.2
5,692,574 A * 12/1997 Terada ..... B25F 5/006 173/162.2
5,697,456 A * 12/1997 Radle ..... B25F 5/006 173/162.2
5,816,121 A * 10/1998 Yoshimizu ..... B25B 21/008 173/176
6,076,616 A * 6/2000 Kramp ..... B25D 17/043 173/162.2
6,148,930 A * 11/2000 Berger ..... B25F 5/006 173/162.2
6,286,610 B1 * 9/2001 Berger ..... B25D 17/24 173/162.1
7,591,325 B2 * 9/2009 Robieu ..... B25D 17/043 173/162.2
7,610,967 B2 * 11/2009 Fischer ..... B25D 17/043 173/162.2
7,967,079 B2 * 6/2011 Stierle ..... B25F 5/006 173/162.2
2003/0037937 A1 * 2/2003 Frauhammer ..... B25D 16/006 173/48
2003/0094294 A1 * 5/2003 Fritz ..... B25F 5/006 173/171
2006/0086515 A1 * 4/2006 Engelfried ..... B25D 17/043 173/162.2
2006/0159577 A1 7/2006 Soika et al.
2006/0185867 A1 * 8/2006 Frauhammer ..... B25D 17/043 173/162.1
2006/0219418 A1 * 10/2006 Arakawa ..... B25D 17/043 173/162.2
2007/0074407 A1 * 4/2007 Serdynski ..... B23D 51/01 30/392
2007/0289762 A1 * 12/2007 Kikukchi ..... B25D 17/043 173/162.1
2008/0047724 A1 2/2008 Fischer et al.
2009/0223693 A1 * 9/2009 Aoki ..... B25D 16/00 173/211
2009/0266571 A1 * 10/2009 Baumann ..... B25D 17/24 173/162.2
2009/0314507 A1 * 12/2009 Iwakami ..... B25D 17/043 173/162.2
2010/0018734 A1 * 1/2010 Frauhammer ..... B25D 16/006 173/171
2010/0155095 A1 * 6/2010 Furusawa ..... B23Q 11/0046 173/198
2010/0186979 A1 * 7/2010 Krauter ..... B25F 5/006 173/162.2
2010/0193209 A1 * 8/2010 Schadow ..... B24B 23/04 173/162.2
2010/0206596 A1 * 8/2010 Kamegai ..... B23D 51/01 173/162.2
2010/0263896 A1 * 10/2010 Brennenstuhl ..... B25F 5/02 173/217
2011/0011608 A1 * 1/2011 Saur ..... B25D 11/062 173/162.2
2011/0088922 A1 * 4/2011 Hirayama ..... B25F 5/02 173/90
2011/0120740 A1 * 5/2011 Moreno ..... B25D 17/043 173/162.2
2011/0308830 A1 * 12/2011 Furusawa ..... B23Q 11/0046 173/198
2012/0031639 A1 * 2/2012 Roberts ..... B25D 17/043 173/162.2
2012/0067605 A1 * 3/2012 Furusawa ..... B25D 17/043 173/162.2
2012/0160533 A1 * 6/2012 Kamegai ..... B25D 17/24 173/162.2
2013/0098648 A1 4/2013 Furusawa et al.
2015/0174748 A1 * 6/2015 Furuta ..... B25C 1/04 227/130
2015/0328764 A1 * 11/2015 Yoshikane ..... B25D 16/00 173/104

FOREIGN PATENT DOCUMENTS

JP 2006-175586 A 7/2006
JP 2007/331072 A 12/2007
JP 2008-030192 A 2/2008
JP A-2010-5751 1/2010

OTHER PUBLICATIONS

Aug. 10, 2016 Office Action issued in Japanese Patent Application No. 2013-113512.

* cited by examiner

RECIPROCATING POWER TOOL

CROSS REFERENCE TO RELATED APPLICATION

The present application claims priority from Japanese Patent Applications No. 2013-113512 filed on May 29, 2013, the disclosure of which is incorporated herein by reference in its entirety.

FIELD OF THE INVENTION

The present invention relates to a reciprocating power tool which performs a predetermined operation by a tool bit.

BACKGROUND OF THE INVENTION

Japanese non-examined laid-open Patent Publication No. 2010-005751 discloses a battery-powered hammer drill having a vibration-proof handle. In this battery-powered hammer drill, a handle designed to be held by a user during operation is connected to a tool body via an elastic element such that it can slide in parallel to an axis of a tool bit.

By provision of the handle constructed as described above, vibration which is caused in a longitudinal direction in the tool body and transmitted to the handle can be reduced.

DISCLOSURE OF THE INVENTION

Problems to be Solved by the Invention

The above-described hammer drill is effective in reducing vibration which is transmitted to the handle in the axial direction of the tool bit, but it is desired to further improve in reduction of vibration in a direction crossing the axial direction of the tool bit.

Accordingly, it is an object of the present invention to improve vibration reduction of a handle in a reciprocating power tool.

Means for Solving the Problems

The above-described problem is solved by the present invention. According to a preferred embodiment of a reciprocating power tool of the present invention, the reciprocating power tool performs an operation on a workpiece by driving a tool bit in an axial direction of the tool bit. The reciprocating power tool has a driving mechanism that drives the tool bit, a tool body that houses the driving mechanism, a handle that is connected to the tool body and a first connection part and a second connection part that connect the handle and the tool body. When the axial direction of the tool bit is defined as a longitudinal direction, a direction crossing the longitudinal direction is defined as a vertical direction and a direction crossing the longitudinal direction and the vertical direction is defined as a transverse direction (lateral direction), the handle is arranged to extend in the vertical direction. The first connection part has an elastic member and connects one end region of the handle in the vertical direction and the tool body via the elastic member. The second connection part has a shaft extending in the transverse direction and connects the other end region of the handle in the vertical direction and the tool body such that the handle can rotate around an axis of the shaft with respect to the tool body. By rotation of the handle around the shaft with respect to the tool body, the elastic element prevents vibration which is caused in the tool body from being transmitted to the handle. The "shaft" in the present invention includes not only a long cylindrical member, but a spherical structure which has a convex spherical surface and a concave spherical surface slidably engaged with the convex spherical surface and can rotate in various directions. As for this spherical structure, it may have a spherical surface either in part or in its entirety.

The "reciprocating power tool" in the present invention typically represents a hammer which performs a hammering operation on a workpiece by striking movement of the tool bit in its axial direction, but the present invention is not limited to this. For example, it suitably includes a hammer drill which performs a hammer drill operation on a workpiece by striking movement and rotation of the tool bit, and a cutting power tool, such as a reciprocating saw and a jig saw, which performs a cutting operation on a workpiece by reciprocating movement of a blade. Further, the "elastic member" suitably includes a spring and a rubber.

According to the present invention, the other end of the handle is connected to the tool body such that it can rotate around the shaft with respect to the tool body, and the rotation of the handle around the shaft with respect to the tool body includes a longitudinal component and a vertical component. By provision of such a construction, vibrations which are caused in the tool body in the longitudinal direction and the vertical direction and transmitted to the handle can be reduced by the elastic member.

According to a further embodiment of the reciprocating power tool of the present invention, the tool body has a battery mounting part on which a battery is detachably mounted, and an intermediate region is provided between the driving mechanism and the battery mounting part in the vertical direction. The shaft and a center of gravity of the tool body with the battery mounted on the battery mounting part are arranged in the intermediate region. By provision of the construction in which the intermediate region is provided between the driving mechanism and the battery mounting part in the vertical direction, the reciprocating power tool is provided in which the battery mounting part is disposed at a position away from an axis of the tool bit. In the reciprocating power tool having such a construction, the center of gravity of the tool body with the battery is displaced (distant) from the axis of the tool bit.

When the reciprocating power tool receives a reaction force from the workpiece during operation, moment is generated around the center of gravity. According to this embodiment, by provision of the construction in which the shaft connecting the other end of the handle and the tool body is also disposed in the intermediate region, the handle follows the movement of the tool body corresponding to the moment generated around the center of gravity.

According to a further embodiment of the reciprocating power tool of the present invention, the shaft and the center of gravity are arranged in the same position in the vertical direction and/or the longitudinal direction.

According to this embodiment, the rotation of the handle around the shaft with respect to the tool body coincides with the moment generated around the center of gravity in the tool body, so that followability of the handle to the movement of the tool body corresponding to the moment is further improved.

According to a further embodiment of the reciprocating power tool of the present invention, the elastic element is fitted on the shaft. The handle and the tool body are connected to each other via the shaft and the elastic element, and the elastic element prevents vibration which is caused in the tool body from being transmitted to the handle. Further, the "elastic element" suitably includes a rubber and a spring. In this case, the manner in which "the elastic element is fitted" suitably includes both the manner in which the elastic element is disposed entirely around the shaft and the manner in which the elastic element is disposed intermittently around the shaft. Further, the "elastic element" may be held either by the tool body or by the handle.

According to this embodiment, transmission of vibration from the tool body to the handle via the shaft can be reduced by the elastic element.

According to a further embodiment of the reciprocating power tool of the present invention, the shaft is configured as an elongate member. The elastic element is fitted on a first region of the shaft in an axial direction of the shaft. The tool body has an elastic element holding part which holds the elastic element and a contact part which can contact with a second region of the shaft other than the first region in the axial direction of the shaft. The contact part blocks movement of the shaft by contact with the second region when the shaft moves in the vertical direction and/or the longitudinal direction by elastic deformation of the elastic element. Typically, the elastic element holding part holds the elastic element in contact therewith. On the other hand, the contact part is disposed away from the shaft in a radial direction of the shaft. The shaft moves in the vertical direction and/or the longitudinal direction by elastic deformation of the elastic element and thereby gets into contact with the contact part. By contact of the shaft and the contact part, the contact part blocks further movement of the shaft. Further, the movement of the shaft in the vertical direction or the longitudinal direction means relative movement of the shaft with respect to the tool body. Further, the second region is typically disposed to be closer to the end of the shaft than the first region in the axial direction of the shaft.

According to this embodiment, the contact part can prevent the shaft from moving more than necessary, so that the elastic element can be avoided from being acted upon by excessive load and durability of the elastic element can be improved.

According to a further embodiment of the reciprocating power tool of the present invention, the tool body is comprised of a left housing and a right housing disposed on the left and the right in the transverse direction. The shaft is made of metal. Each of the right and left housings is provided with the elastic element holding part which holds the elastic element. Typically, the elastic element is comprised of a left elastic part for the elastic element holding part of the left housing and a right elastic part for the elastic element holding part of the right housing. Specifically, the elastic element is comprised of a plurality of elastic parts. Further, the shaft has a handle contact part provided between the left and right elastic parts in the axial direction of the shaft and the handle is rotatably held around the axis of the shaft in contact with the handle contact part. In other words, the handle contact part is provided between the first region on which the elastic element is fitted.

According to this embodiment, by provision of the metal shaft, strength of the shaft can be ensured. Further, the elastic element can be held by the left and right housings.

According to a further embodiment of the reciprocating power tool of the present invention, the elastic member and the shaft are disposed at the same position in the longitudinal direction and the elastic member can extend and contract in the longitudinal direction.

By provision of the above-described construction, in the reciprocating power tool which performs an operation by driving the tool bit in the longitudinal direction, vibration in the longitudinal direction which is much larger than vibration in the vertical direction can be effectively reduced.

According to a further embodiment of the reciprocating power tool of the present invention, the handle is disposed on the axis of the tool bit.

According to this embodiment, the reciprocating power tool is suitable for an operation which is performed while applying a force to the handle in such a manner as to press the tool bit against the workpiece.

According to a further embodiment of the reciprocating power tool of the present invention, the battery mounting part is provided on the tool body below the handle in the vertical direction.

According to this embodiment, by provision of the construction in which the battery mounting part is provided on the tool body below the handle, it can be more easily designed such that the center of gravity of the tool body with the battery mounted on the battery mounting part is positioned closer to the shaft around which the handle rotates.

Effect of the Invention

Accordingly, vibration isolation of a handle in a reciprocating power tool is improved.

Other objects, features and advantages of the invention will be readily understood after reading the following detailed description together with the accompanying drawings and the claims.

BEST MODES FOR PERFORMING THE INVENTION

Each of the additional features and method steps disclosed above and below may be utilized separately or in conjunction with other features and method steps to provide and manufacture improved reciprocating power tools and method for using such reciprocating power tools and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
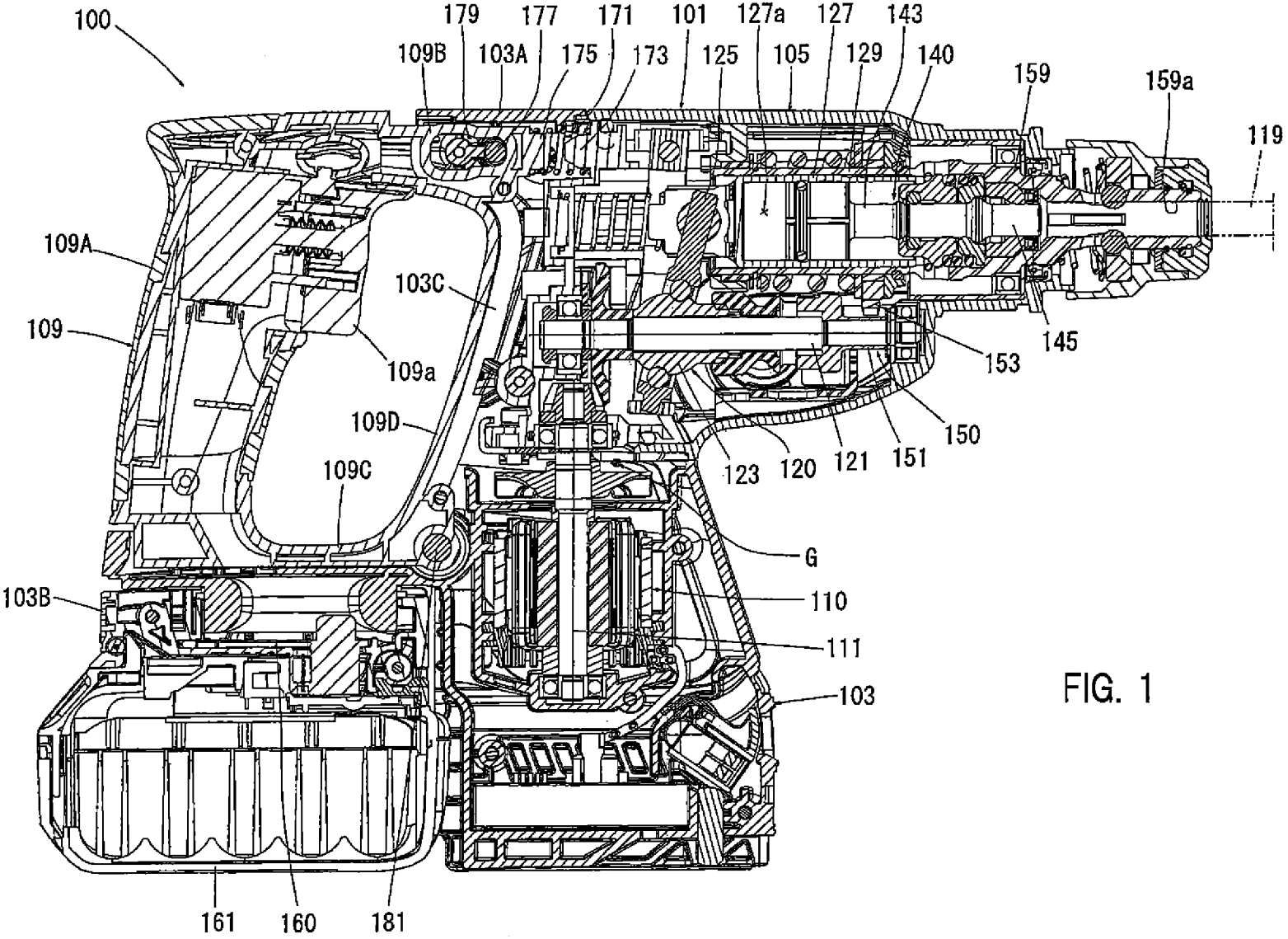
FIG. 1 is a sectional side view showing an entire battery-powered hammer drill according to an exemplary embodiment of this invention.
Figure 2:
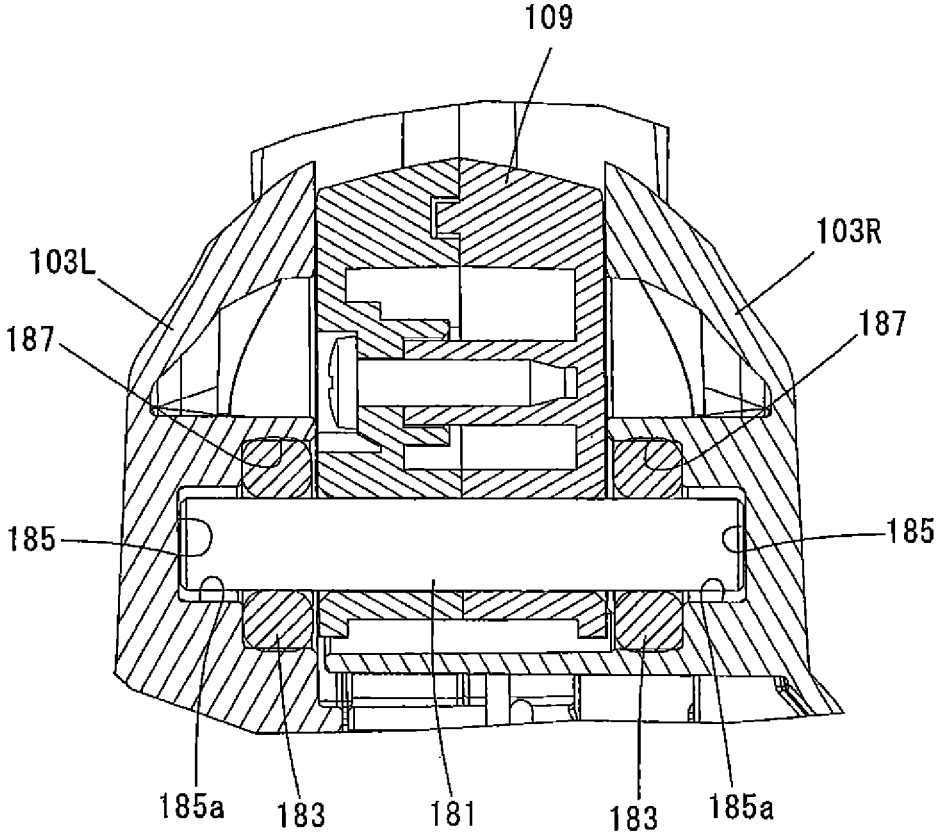
FIG. 2 is a sectional view showing a rotating part of a handle.

An exemplary embodiment of the present invention is now described with reference to FIGS. 1 and 2. In this embodiment of the present invention, a battery-powered hammer drill is described as a representative embodiment of a reciprocating power tool. As shown in FIG. 1, the battery-powered hammer drill 100 is an impact tool which has a hammer bit 119 attached thereto and performs chipping, drilling or other similar operation on a workpiece by causing the hammer bit 119 to perform striking movement in its axial direction and rotation around its axis. The hammer bit 119 is a feature that corresponds to the "tool bit" according to the present invention.

The hammer drill 100 mainly includes a body 101 that forms an outer shell of the hammer drill 100. The hammer bit 119 is detachably coupled to a tip end region of the body 101 via a cylindrical tool holder 159. The hammer bit 119 is inserted into a bit insertion hole 159*a* of the tool holder 159 and held such that it is allowed to reciprocate in its axial direction with respect to the tool holder 159 and prevented from rotating in its circumferential direction with respect to the tool holder 159.

The body 101 mainly includes a motor housing 103 that houses an electric motor 110, and a gear housing 105 that houses a motion converting mechanism 120, a striking mechanism 140 and a power transmitting mechanism 150. A handgrip 109 designed to be held by a user is connected to the body 101 on the side opposite to the hammer bit 119 in the axial direction of the hammer bit 119. The body 101 and the handgrip 109 are features that correspond to the "tool body" and the "handle", respectively, according to the present invention.

In this embodiment, for the sake of convenience of explanation, the side of the hammer bit 119 is defined as the "front" or "front region" and the side of the handgrip 109 as the "rear" or "rear region" in the axial direction of the hammer bit 119 or in the longitudinal direction of the body 101. Further, an upper side of a paper plane in FIG. 1 is defined as an "upper side" or "upper region" and a lower side of the paper plane as a "lower side" or "lower region".

The body 101 has the gear housing 105 in front and the motor housing 103 in the rear in the axial direction of the hammer bit 119. The handgrip 109 is disposed on the rear of the motor housing 103. The motor housing 103 extends downward from the underside of the gear housing 105 and houses the electric motor 110 within this extending region. The electric motor 110 is disposed such that its rotation axis extends in a vertical direction and crosses an axially extending axis of striking movement of the hammer bit 119. Further, each of the motor housing 103, the gear housing 105 and the handgrip 109 which form the body 101 has right and left halves connected together along the axial direction of the hammer bit 119.

A rotating output of the electric motor 110 is appropriately converted into linear motion by the motion converting mechanism 120 and then transmitted to the striking mechanism 140. As a result, an impact force is generated in the axial direction of the hammer bit 119 (a horizontal direction as viewed in FIG. 1) via the striking mechanism 140. The motion converting mechanism 120 and the striking mechanism 140 are features that correspond to the "driving mechanism" according to the present invention. Further, the speed of the rotating output of the electric motor 110 is appropriately reduced by the power transmitting mechanism 150 and then transmitted to the hammer bit 119. As a result, the hammer bit 119 is caused to rotate in a circumferential direction. The electric motor 110 is energized by depressing a trigger 109*a* disposed on the handgrip 109.

The motion converting mechanism 120 is disposed above a motor shaft 111 of the electric motor 110 and serves to convert the rotating output of the motor shaft 111 into linear motion in the longitudinal direction of the hammer drill 100. The motion converting mechanism 120 mainly includes an intermediate shaft 121 which is rotationally driven by the motor shaft 111, a rotating element 123 fitted onto the intermediate shaft 121, a swinging member 125 which is caused to swing in the longitudinal direction of the hammer drill 100 by rotation of the intermediate shaft 121 (the rotating element 123), a driving element in the form of a cylindrical piston 127 which is caused to reciprocate in the longitudinal direction of the hammer drill 100 by swinging movement of the swinging member 125, and a cylinder 129 which houses the piston 127. The motor shaft 111 is disposed perpendicularly to the intermediate shaft 121. The cylinder 129 is integrally formed with the tool holder 159 as a rear region of the tool holder 159.

The striking mechanism 140 is disposed above the motion converting mechanism 120 and rearward of the tool holder 159. The motion converting mechanism 120 converts the rotating output of the electric motor 110 into linear motion in the longitudinal direction of the hammer drill 100, and the striking mechanism 140 transmits this linear motion to the hammer bit 119 as a striking force. The striking mechanism 140 mainly includes a striking element in the form of a striker 143 which is slidably disposed within the cylindrical piston 127 and an impact bolt 145 which is disposed in front of the striker 143, and the striker 143 collides with the impact bolt 145. Further, a space formed behind the striker 143 within the piston 127 forms an air chamber 127*a* which serves to transmit sliding movement of the piston 127 to the striker 143 via fluctuations of air pressure.

The power transmitting mechanism 150 is disposed forward of the motion converting mechanism 120 and serves to transmit the rotating output of the electric motor 110 transmitted via the intermediate shaft 121 of the motion converting mechanism 120, to the tool holder 159. The power transmitting mechanism 150 mainly includes a gear speed reducing mechanism having a plurality of gears such as a first gear 151 which rotates together with the intermediate shaft 121, and a second gear 153 which is engaged with the first gear 151 and fitted onto the tool holder 159 (the cylinder 129).

As shown in FIG. 1, an upper connecting part 103A which extends substantially horizontally in a rearward direction from an upper rear end of the motor housing 103, a lower connecting part 103B which extends substantially horizontally in a rearward direction from a generally middle of the motor housing 103 in the vertical direction and an intermediate wall part 103C which connects the upper connecting part 103A and the lower connecting part 103B are provided at the rear of the motor housing 103. These parts define a space which is generally U-shaped in side view above the rear of the motor housing 103, and the handgrip 109 is disposed in this space.

A battery mounting part 160 is formed on an underside of the lower connecting part 103B of the motor housing 103, or behind the motor housing 103 and below the handgrip 109. A battery pack 161 which serves to feed driving current to the electric motor 110 is detachably mounted on the battery mounting part 160 by sliding it horizontally forward from the rear. The battery mounting part 160 and the battery pack 161 are features that correspond to the "battery mounting part" and the "battery", respectively, according to the present invention. Further, in this embodiment, a center of gravity G of the hammer drill 100 with the battery pack 161 mounted on the battery mounting part 160 is set in an intermediate region between the motion converting mechanism 120 and the battery mounting part 160.

As shown in FIG. 1, the handgrip 109 is disposed in the space behind the motor housing 103 and has a grip part 109A, an upper arm part 109B, a lower arm part 109C and a stay 109D. The grip part 109A extends in a vertical direction which crosses the axial direction of the hammer bit 119 or the extending direction of the axis of the striking movement on the same plane. The upper arm part 109B extends forward from an upper end of the grip part 109A in the extending direction. The lower arm part 109C extends forward from a lower end of the grip part 109A in the extending direction. The stay 109D extends generally parallel to the grip part 109A and connects extending ends of the upper arm part 109B and the lower arm part 109C. With such a construction, the handgrip 109 is configured as a closed-loop one-piece frame structure and increased in rigidity.

The motor housing 103 is formed in two halves as right and left housings 103R, 103L (see FIG. 2) along the axial direction of the hammer bit 119. The right and left housings 1038, 103L are arranged to hold a region of the handgrip 109 disposed in the space behind the motor housing 103, except the grip part 109A and part of the upper arm part 109B, therebetween from both sides of the handgrip 109. Specifically, a front region of the upper arm part 109B is held by the upper connecting part 103A, the entire lower arm part 109C is held by the lower connecting part 103B, and the entire stay 109D is held by the intermediate wall part 103C. In this case, a predetermined clearance is provided between opposed surfaces of the handgrip 109 and the motor housing 103 in order to allow the handgrip 109 to move with respect to the motor housing 103. The upper connecting part 103A and the upper arm part 109B are features that correspond to the "first connection part", and the lower connecting part 103B and the lower arm part 109C are features that correspond to the "second connection part" according to this invention.

In the handgrip 109 disposed in the space behind the motor housing 103, an upper front portion of the handgrip 109 or specifically an intersection of the upper arm part 109B and the stay 109D is elastically connected to the gear housing 105 via a compression coil spring 171, and a lower front portion of the handgrip 109 or specifically an intersection of the lower arm part 109C and the stay 109D is supported on the motor housing 103 via a support shaft 181 such that it can rotate around a transverse axis of the support shaft 181. The compression coil spring 171 and the support shaft 181 are features that correspond to the "elastic member" and the "shaft", respectively, according to the present invention.

The compression coil spring 171 is disposed above the axis of striking movement of the hammer bit 119 such that it extends in the longitudinal direction within the upper connecting part 103A of the motor housing 103. Further, a front end of the compression coil spring 171 is supported by a spring receiver 173 formed on the rear of the gear housing 105 and a rear end of the compression coil spring 171 is supported by a spring receiver 175 formed at the intersection of the upper arm part 109B and the stay 109D of the handgrip 109. With such a construction, the spring force of the compression coil spring 171 acts rearward on the handgrip 109. Further, it is preferable that one compression coil spring 171 is disposed above the axis of striking movement of the hammer bit 119.

A metal stopper pin 177 is provided in the upper connecting part 103A of the motor housing 103 and serves to receive the spring force of the compression coil spring 171 acting on the handgrip 109. The stopper pin 177 extends through a transverse hole 179 formed rearward of the compression coil spring 171 in the upper arm part 109B of the handgrip 109, and ends of the stopper pin 177 are fixed to the upper connecting part 103A. The stopper pin 177 receives the spring force of the compression coil spring 171 acting on the handgrip 109 when the stopper pin 177 contacts with a front wall of the transverse hole 179. When the stopper pin 177 is moved away from the front wall of the transverse hole 179, the stopper pin 177 is allowed to move relatively in the longitudinal direction and the vertical direction within the transverse hole 179.

The support shaft 181 is disposed below the axis of striking movement of the hammer bit 119 and above the battery mounting part 160, or specifically in the vicinity of the intersection of the lower connecting part 103B and the intermediate wall part 103C of the motor housing 103 and below the center of gravity G of the hammer drill 100. The support shaft 181 is made of metal. As shown in FIG. 2, the support shaft 181 extends through the handgrip 109 in the transverse direction with its both ends protruding from side surfaces of the handgrip, and each of the protruding ends is supported by the motor housing 103 via an elastically deformable O-ring 183. The O-ring 183 is a feature that corresponds to the "elastic element" according to the present invention.

In each of the right and left housings 1038, 103L forming the motor housing 103, a recessed shaft hole 185 in which an end of the support shaft 181 is loosely fitted, and a housing recess 187 which holds the O-ring 183 are formed side by side in the axial direction of the support shaft 181. The O-ring 183 disposed in the housing recess 187 is fitted on an outer circumferential surface of the support shaft 181 and can elastically deform so as to allow the support shaft 181 to move in its radial direction. The outer circumferential surface of the support shaft 181 on which the O-ring 183 is fitted is a feature that corresponds to the "first region" according to the present invention. The end of the support shaft 181 is loosely fitted in the shaft hole 185 and a predetermined clearance is formed between the outer circumferential surface of the end of the support shaft 181 and an inner circumferential surface 185*a* of the shaft hole 185. Specifically, the end of the support shaft 181 is allowed to move in the radial direction within the range of the clearance by elastic deformation of the O-ring 183. Even if the end of the support shaft 181 tends to move beyond this range, such movement is prevented by contact with the inner circumferential surface 185*a* of the shaft hole 185. The housing recess 187, the inner circumferential surface 185*a* of the shaft hole 185 and the outer circumferential surface of the support shaft 181 which can contact with the inner circumferential surface 185*a* of the shaft hole 185 are features that correspond to the "elastic element holding part", the "contact part" and the "second region", respectively, according to the present invention.

As described above, the upper end region of the handgrip 109 is elastically connected to the gear housing 105 via the compression coil spring 171, and its lower end region is connected to the motor housing 103 via the support shaft 181 such that it can rotate around the transverse axis.

The hammer drill 100 according to this embodiment is constructed as described above. In an operation using the hammer drill 100, the user holds the grip part 109A of the handgrip 109 and performs an operation while applying a forward pressing force to the hammer drill 100. The handgrip 109 to which the forward pressing force is applied is caused to rotate forward around the support shaft 181 with respect to the motor housing 103 of the body 101 while compressing the compression coil spring 171. Thus, the stopper pin 177 fixed to the motor housing 103 is caused to move rearward with respect to the motor housing 103 within the transverse hole 179 of the upper arm part 109B and move away from the front wall of the transverse hole 179. As a result, the handgrip 109 is allowed to move in the longitudinal direction and the vertical direction with respect to the stopper pin 177.

During operation using the hammer drill 100, vibration is mainly caused in the longitudinal direction on the axis of the hammer bit 119 in the body 101. According to this embodiment, the front upper end of the handgrip 109 is elastically connected to the body 101 via the compression coil spring 171 and its front lower end is connected to the body 101 such that it can rotate around the horizontal support shaft 181 with respect to the body 101. With such a construction, vibration which is caused in the longitudinal direction in the body 101 is coped with (or reduced) by a longitudinal component of relative rotation of the handgrip 109 on the support shaft 181. Further, in the body 101, vibration is caused not only in the longitudinal direction but also in the vertical direction. The vertical vibration is coped with (or reduced) by a vertical component of relative rotation of the handgrip 109 on the support shaft 181. Specifically, according to this embodiment, when the handgrip 109 rotates around the support shaft 181 with respect to the body 101, vibrations which are caused in the body 101 in the vertical direction and the longitudinal direction and transmitted to the handgrip 109 can be reduced by the compression coil spring 171.

In the hammer drill 100 in which an operation is performed by driving the hammer bit 119 in the axial direction of the hammer bit 119 or the longitudinal direction of the hammer drill 100, vibration caused in the body 101 is much larger in the longitudinal direction than in the vertical direction. In this embodiment, the compression coil spring 171 and the support shaft 181 are disposed at the same position in the axial direction of the hammer bit 119. Specifically, the support shaft 181 is disposed right below the compression coil spring 171. Further, the compression coil spring 171 is disposed in parallel to the axis of the hammer bit 119 and can extend and contract. With such a construction, vibration in the longitudinal direction can be effectively reduced.

The battery pack 161 mounted on the battery mounting part 160 has a heavy weight. Therefore, when the battery pack 161 is mounted on the battery mounting part 160, as described above, the center of gravity G of the hammer drill 100 with the battery pack 161 (hereinafter referred to as the center of gravity of the hammer drill 100) is located at a lower position away from the axis of striking movement of the hammer bit 119. Specifically, as shown in FIG. 1, the center of gravity G of the hammer drill 100 is set in an intermediate region between the motion converting mechanism 120 for driving the hammer bit 119 and the battery mounting part 160 and slightly above the support shaft 181. Further, when the hammer bit 119 strikes the workpiece, the hammer drill 100 receives a reaction force from the workpiece. As a result, moment is generated around the center of gravity.

In this embodiment, the position of the support shaft 181 is set based on the above. Specifically, the position of the support shaft 181 is set as close as possible to the center of gravity G of the hammer drill 100, or more preferably to coincide with it. By provision of such a construction, rotation of the body 101 corresponding to moment generated around the center of gravity can coincide with or approximate to relative rotation of the handgrip 109 around the support shaft 181 with respect to the body 101. As a result, the vibration proofing effect can be enhanced. Further, in this embodiment, as shown in FIG. 1, the position of the support shaft 181 is shown below the center of gravity G, but it can also be set above the center of gravity G.

According to this embodiment, with the construction in which the elastically deformable O-ring 183 is disposed between the motor housing 103 and the support shaft 181, the O-ring 183 can reduce vibrations which are caused in the longitudinal direction and the vertical direction in the body 101 and transmitted from the motor housing 103 to the handgrip 109 via the support shaft 181.

According to this embodiment, maximum movement of the support shaft 181 in the radial direction by deformation of the O-ring 183 is blocked by the inner circumferential surface 185*a* of the shaft hole 185 in which the end of the support shaft 181 is loosely fitted. With such a construction in which the moving range of the support shaft 181 is limited, the O-ring 183 can be avoided from being acted upon by excessive load, so that durability of the O-ring 183 can be improved.

According to this embodiment, the motor housing 103 is formed in two halves as the right and left housings 103R, 103L along the axial direction of the hammer bit 119, and the shaft hole 185 is formed in opposite division surfaces of the right and left housings 103R, 103L. With this construction, when the right and left housings 103R, 103L are disposed to hold the handgrip 109 therebetween from both sides of the handgrip 109, the right and left housings 103R, 103L can be assembled to the handgrip 109 by inserting the ends of the support shaft 181 formed through the handgrip 109 into the shaft holes 186 of the right and left housings 103R, 103L. As a result, the ease of assembling is enhanced.

In this embodiment, the O-ring 183 is disposed between the motor housing 103 and the support shaft 181. The O-ring 183 may however be disposed between the handgrip 109 and the support shaft 181. Further, in place of the compression coil spring 171, a rubber may be used.

In this embodiment, the hammer drill is described as the representative example of the reciprocating power tool, but the present invention may also be applied to a hammer which causes the hammer bit 119 to perform only striking movement in its axial direction, or a cutting tool, such as a reciprocating saw and a jig saw, which performs a cutting operation on a workpiece by reciprocating movement of a blade.

(Correspondences Between the Features of the Embodiment and the Features of the Invention)

Correspondences between the features of the embodiment and the features of the invention are as follow. Further, the above-described embodiment is a representative example for embodying the present invention, and the present invention is not limited to the construction of the representative embodiment.

The body 101 is a feature that corresponds to the "tool body" according to the present invention.

The handgrip 109 is a feature that corresponds to the "handle" according to the present invention.

The hammer bit 119 is a feature that corresponds to the "tool bit" according to the present invention.

The motion converting mechanism 120 and the striking mechanism 140 are features that correspond to the "driving mechanism" according to the present invention.

The upper connecting part 103A and the upper arm part 109B are features that correspond to the "first connection part" according to the present invention.

The lower connecting part 103B and the lower arm part 109C are features that correspond to the "second connection part" according to the present invention.

The compression coil spring 171 is a feature that corresponds to the "elastic member" according to the present invention.

The support shaft 181 is a feature that corresponds to the "shaft" according to the present invention.

The O-ring 183 is a feature that corresponds to the "elastic element" according to the present invention.

The outer circumferential surface of the support shaft 181 on which the O-ring 183 is fitted is a feature that corresponds to the "first region" according to the present invention.

The inner circumferential surface 185*a* of the shaft hole 185 is a feature that corresponds to the "contact part" according to the present invention.

The outer circumferential surface of the support shaft 185 which can contact with the inner circumferential surface 185*a* of the shaft hole 185 is a feature that corresponds to the "second region" according to the present invention.

The battery mounting part 160 is a feature that corresponds to the "battery mounting part" according to the present invention.

The battery pack 161 is a feature that corresponds to the "battery" according to the present invention.

The housing recess 187 is a feature that corresponds to the "elastic element holding part" according to the present invention.

DESCRIPTION OF NUMERALS

100 hammer chill
101 body
103 motor housing
103A upper connecting part
103B lower connecting part
103C intermediate wall part
103R right housing
103L left housing
105 gear housing
109 handgrip
109A grip part
109B upper arm part
109C lower arm part
109D stay
109*a* trigger
110 electric motor
111 motor shaft
119 hammer bit
120 motion converting mechanism
121 intermediate shaft
123 rotating element
125 swinging member
127 cylindrical piston
127*a* air chamber
129 cylinder
140 striking mechanism
143 striker
145 impact bolt
150 power transmitting mechanism
151 first gear
153 second gear
159 tool holder
159*a* bit insertion hole
160 battery mounting part
161 battery pack
171 compression coil spring
173 spring receiver
175 spring receiver
177 stopper pin
179 transverse hole
181 support shaft
183 O-ring
185 shaft hole
185*a* inner circumferential surface
187 housing recess

What we claim is:

1. A reciprocating power tool, which performs an operation on a workpiece by driving a tool bit in an axial axis of the tool bit, comprising:

a driving mechanism that drives the tool bit, a tool body that houses the driving mechanism, a handle that is connected to the tool body, and a first connection part and a second connection part that connect the handle and the tool body, wherein:

when the axial axis of the tool bit is defined as a longitudinal axis, an axis crossing the longitudinal axis is defined as a vertical axis and an axis crossing the longitudinal axis and the vertical axis is defined as a transverse axis, the handle is arranged to extend in the vertical axis, the first connection part has an elastic member and connects one end region of the handle in the vertical axis and the tool body via the elastic member, the second connection part has a shaft extending in the transverse axis and connects the other end region of the handle in the vertical axis and the tool body such that the handle can rotate around an axis of the shaft with respect to the tool body, by rotation of the handle around the shaft with respect to the tool body, the elastic member prevents vibration which is caused in the tool body from being transmitted to the handle, the tool body has a battery mounting part on which a battery is detachably mounted, an intermediate region is provided between the driving mechanism and the battery mounting part in the vertical axis, and the shaft and a center of gravity of the tool body with the battery mounted on the battery mounting part are arranged in the intermediate region.

2. The reciprocating power tool as defined in claim 1, wherein the shaft and the center of gravity are arranged in the same vertical position.

3. The reciprocating power tool as defined in claim 1, wherein the shaft and the center of gravity are arranged in the same longitudinal position.

4. The reciprocating power tool as defined in claim 1, wherein an elastic element is fitted on the shaft, and the handle and the tool body are connected to each other via the shaft and the elastic element, and the elastic element prevents vibration which is caused in the tool body from being transmitted to the handle.

5. The reciprocating power tool as defined in claim 4, wherein:

the shaft is configured as an elongate member, the elastic element is fitted on a first region of the shaft in an axial axis of the shaft, the tool body has an elastic element holding part which holds the elastic element and a contact part which can contact with a second region of the shaft other than the first region in the axial axis of the shaft, and the contact part blocks movement of the shaft by contact with the second region when the shaft moves in the vertical axis and/or the longitudinal axis by elastic deformation of the elastic element.

6. The reciprocating power tool as defined in claim 5, wherein:

the elastic element holding part holds the elastic element in contact therewith, the contact part is disposed away from the shaft in a radial axis of the shaft, and the shaft moves in the vertical axis and/or the longitudinal axis by elastic deformation of the elastic element, thereby getting into contact with the contact part.

7. The reciprocating power tool as defined in claim 5, wherein:

the tool body comprises a left housing and a right housing disposed on the left and the right in the transverse axis, the shaft is made of metal, and each of the right and left housings is provided with the elastic element holding part which holds the elastic element.

8. The reciprocating power tool as defined in claim 7, wherein the elastic element comprises a left elastic part for the elastic element holding part of the left housing and a right elastic part for the elastic element holding part of the right housing.

9. The reciprocating power tool as defined in claim 8, wherein the shaft has a handle contact part provided between the left and right elastic parts in the axial axis of the shaft and the handle is rotatably held around the axis of the shaft in contact with the handle contact part.

10. The reciprocating power tool as defined in claim 1, wherein the elastic member and the shaft are disposed at the same longitudinal position and the elastic member can extend and contract in the longitudinal axis.

11. The reciprocating power tool as defined in claim 1, wherein the handle is disposed on the axis of the tool bit.

12. The reciprocating power tool as defined in claim 1, wherein the battery mounting part is provided on the tool body below the handle in the vertical axis.

13. The reciprocating power tool as defined in claim 1, wherein the shaft and the center of gravity are arranged in the same vertical and longitudinal position.

14. The reciprocating power tool as defined in claim 13, wherein the elastic member and the shaft are disposed at the same longitudinal position and the elastic member can extend and contract in the longitudinal axis.

15. The reciprocating power tool as defined in claim 1, wherein:

the tool body includes a gear housing and a motor housing, the gear housing houses the driving mechanism and the motor housing being disposed on a rear side of the gear housing and extending lower than the gear housing;

an upper end part of the handle is connected to the motor housing via the first connection part and a lower end part of the handle is connected to the motor housing via the second connection part;

the motor housing includes an extending part extending rearward from a generally middle of the motor housing in the vertical axis, below the handle; and the battery mounting part is formed on an underside of the extending part.

* * * * *